US009358828B2

(12) United States Patent
Izawa et al.

(10) Patent No.: US 9,358,828 B2
(45) Date of Patent: Jun. 7, 2016

(54) MECHANICAL PENCIL

(71) Applicant: MITSUBISHI PENCIL COMPANY, LIMITED, Tokyo (JP)

(72) Inventors: Hirotake Izawa, Yokohama (JP); Kei Oomoto, Yokohama (JP)

(73) Assignee: MITSUBISHI PENCIL COMPANY, LIMITED, Tokyo (JP)

( * ) Notice: Subject to any disclaimer, the term of this patent is extended or adjusted under 35 U.S.C. 154(b) by 0 days.

(21) Appl. No.: 14/376,534

(22) PCT Filed: Feb. 20, 2013

(86) PCT No.: PCT/JP2013/054108

§ 371 (c)(1),
(2) Date: Aug. 4, 2014

(87) PCT Pub. No.: WO2013/133016

PCT Pub. Date: Sep. 12, 2013

(65) Prior Publication Data

US 2015/0023714 A1 Jan. 22, 2015

(30) Foreign Application Priority Data

Mar. 7, 2012 (JP) ..... 2012-050574

(51) Int. Cl.
*B43K 21/027* (2006.01)
*B43K 21/22* (2006.01)
(Continued)

(52) U.S. Cl.
CPC ..... *B43K 21/22* (2013.01); *B43K 21/003* (2013.01); *B43K 21/02* (2013.01); *B43K 21/027* (2013.01); *B43K 21/16* (2013.01)

(58) Field of Classification Search
CPC ..... B43K 21/00; B43K 21/02; B43K 21/027
USPC ..... 401/92, 93, 94
See application file for complete search history.

(56) References Cited

U.S. PATENT DOCUMENTS 7,802,936 B1 * 9/2010 Izawa et al. ..... 401/93

FOREIGN PATENT DOCUMENTS

CN 2264663 Y 10/1997
JP 57-174299 A 10/1982
(Continued)

OTHER PUBLICATIONS

International Search Report dated Apr. 23, 2013, issued in corresponding application No. PCT/JP2013/054108.
(Continued)

*Primary Examiner* — Jennifer C Chiang
*Assistant Examiner* — Joshua Wiljanen
(74) *Attorney, Agent, or Firm* — Westerman, Hattori, Daniels & Adrian, LLP

(57) ABSTRACT

A mechanical pencil is provided which does not require operation of removing or re-fitting a cap but allows writing immediately after supplying a writing lead. A lead fixing chuck 4 which is moved back and forth in conjunction with knock operation of a knock bar 22 to release and grip the writing lead L, and a holder chuck 9 which is provided in front of the lead fixing chuck and holds the writing lead frictionally are arranged such that the writing lead can be gradually inched out by repeating the knock operation. An open/close mechanism having an open/close valve 27 is provided in which a writing lead feeding unit is opened in a situation where the grip of the lead fixing chuck 4 on the writing lead is released by the knock operation, and the holder chuck 9 is disposed proximate to a writing lead outlet.

5 Claims, 8 Drawing Sheets

(51) Int. Cl.

| | |
|---|---|
| ***B43K 21/16*** | (2006.01) |
| ***B43K 21/00*** | (2006.01) |
| ***B43K 21/02*** | (2006.01) |

(56) References Cited

FOREIGN PATENT DOCUMENTS

| | | | |
|---|---|---|---|
| JP | 58-151087 | U | 10/1983 |
| JP | 1-132780 | U | 9/1989 |
| JP | 2000-127673 | A | 5/2000 |
| JP | 2002-200880 | A | 7/2002 |
| JP | 2011-116028 | A | 6/2011 |

OTHER PUBLICATIONS

Office Action dated May 25, 2015, issued in counterpart Chinese patent application No. 201380012996.1 (6 pages).

* cited by examiner (A)

(B)

(C)

MECHANICAL PENCIL

TECHNICAL FIELD

The present invention relates to a mechanical pencil in which a writing lead (refill lead) can easily be supplied and the supplied writing lead is inched out of a base member to allow writing at once.

BACKGROUND ART

As is well known, a knock-type mechanical pencil in which a cap as a knock cover is detachably attached to a rear end portion of a body cylinder. As this cap is knocked in the axial direction, a writing lead (refill lead) accommodated in a lead case within a body cylinder is gradually inched out of a base member at a tip end side of the body cylinder by the action of a lead fixing chuck and a holder chuck.

In this case, when the writing lead is consumed and another writing lead is supplied, the above-mentioned cap is removed and the new writing lead is supplied to a feeding unit at a rear end portion of the lead case, and it is necessary to reattach the above-mentioned cap to the rear end portion of the body cylinder. Further, in addition to attachment/detachment operation of the above-mentioned cap, attachment/detachment operation of an eraser is also needed in the mechanical pencil in which the eraser is provided within the above-mentioned cap.

After supplying the writing lead, by repeating the knock operation of the above-mentioned reattached cap, the supplied writing lead is gradually inched out of a writing lead outlet of a pipe end projecting from the base member, for example, thus resulting in a situation where writing is allowed.

As described above, according to the conventional knock-type mechanical pencil, after recognizing that the writing lead has been consumed, a new writing lead is supplied. Thus, removal or reattachment of the cap and a number of knock operations are needed until the writing lead is inched out in order to allow writing again, which is troublesome for anybody.

Then, the present applicant has proposed previously a mechanical pencil in which removal or reattachement of the cap can be omitted when supplying the writing lead, which is disclosed in Patent Document 1.

PRIOR ART DOCUMENT

Patent Document

Patent Document 1: Japanese Patent Application Publication No. 2000-127673

SUMMARY OF THE INVENTION

Problems to be Solved by the Invention

According to the mechanical pencil disclosed in Patent Document above, it is arranged that the writing lead feeding unit is opened by rotating the cap in the circumferential direction by a half revolution, so that the writing lead can easily be supplied, without removing or reattaching the cap.

However, as is conventional, a number of knock operations are required until the writing lead is inched from the above-mentioned writing lead outlet, such as a pipe end, after supplying the writing lead.

The present invention aims to provide a mechanical pencil in which removal or reattachment of a cap can be avoided when supplying the writing lead, and after supplying the writing lead, the thus supplied writing lead can be inched out of the writing lead outlet, such as a pipe end, by a few knock operations, for example.

Means for Solving the Problems

The mechanical pencil in accordance with the present invention made in order to solve the above-mentioned problems is a mechanical pencil having a lead fixing chuck which is moved back and forth in conjunction with knock operation of a knock bar to grasp and release a writing lead and a holder chuck which is provided in front of the above-mentioned lead fixing chuck and holds the above-mentioned writing lead frictionally so that the above-mentioned writing lead can be gradually inched out by repeating the above-mentioned knock operation, wherein an open/close mechanism for a writing lead feeding unit is provided in which the writing lead feeding unit for the above-mentioned writing lead is opened in a situation where a grip of the above-mentioned lead fixing chuck on the writing lead is released by the above-mentioned knock operation, and the above-mentioned holder chuck is disposed proximate to an outlet for the above-mentioned writing lead.

In this case, the open/close mechanism for the writing lead feeding unit in one preferred embodiment is constituted by a knock cover which is attached to the above-mentioned knock bar and has a writing lead inserting pipe in an axial direction, and an open/close valve which is made of a flexible material and through which a tip portion of the above-mentioned writing lead inserting pipe is inserted by forward movement by knock operation of the above-mentioned knock cover to open the lead feeding unit.

In addition, it is desirable that the above-mentioned open/close valve is formed by providing a thin film of a rubber material with a slit, and a tip portion of the above-mentioned writing lead inserting pipe provided for the above-mentioned knock cover is inserted into the above-mentioned slit of the rubber material by the above-mentioned knock operation to open the writing lead feeding unit.

Further, the open/close mechanism for the writing lead feeding unit in another preferred embodiment is arranged such that the above-mentioned knock bar may be rotationally driven and moved in the axial direction by knock operation, and an opening formed at the above-mentioned knock bar side and an opening formed at a knock cover side attached to the above-mentioned knock bar are aligned in the axial direction so as to open the writing lead feeding unit.

In this case, it is desirable that the above-mentioned knock bar is subjected to knock operation and locked in a situation where it has moved forward in the axial direction, then subjected to knock operation again and retreats in the axial direction to be unlocked, the writing lead feeding unit is opened, and the grip of the above-mentioned lead fixing chuck on the writing lead is released in the locked situation where the above-mentioned knock bar has moved forward in the axial direction.

Effects of the Invention

As described above, according to the mechanical pencil in accordance with the present invention, since it is arranged that the grip of the lead fixing chuck on the writing lead is released by knock operation and the writing lead feeding unit is opened, the writing lead supplied through the above-mentioned feeding unit enters as it is by gravity in the lead fixing chuck in a situation where the grip is released.

Furthermore, since the holder chuck which holds the writing lead by friction is disposed proximate to the writing lead outlet, such as for example a pipe end which projects from the base member, the tip portion of the supplied writing lead immediately reaches this holder chuck portion.

Therefore, the tip portion of the supplied writing lead can be inched from the above-mentioned outlet by knocking the knock cover twice or so, resulting in a situation where writing is allowed. Thus, when supplying the writing lead, it is possible to avoid conventional removal or reattachment of a cap and the knock operation that has been necessarily repeated many times, and troublesome operations experienced when supplying the writing lead can be avoided.

Figure 1:
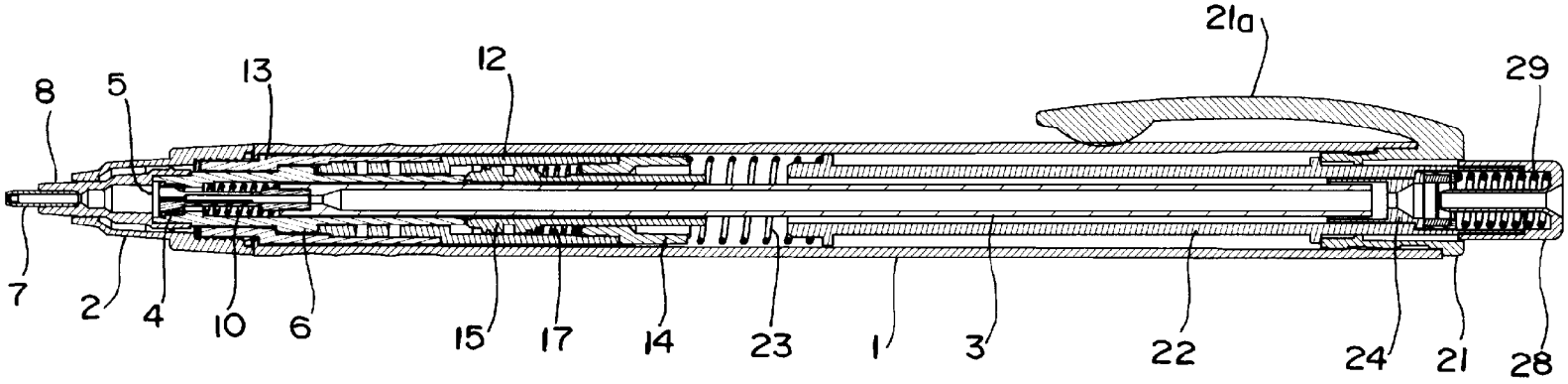
FIG. 1 is a longitudinal sectional view showing a mechanical pencil of a first preferred embodiment in accordance with the present invention.

Hereinafter, a mechanical pencil in accordance with the present invention will be described with reference to the preferred embodiments illustrated in the drawings. In each of the drawings as illustrated below, like parts or those achieve like functions are referred to by like reference signs, but reference signs are assigned to typical parts in some drawings, and the detailed structures may be described with reference to reference signs used in other drawings for the sake of brevity.

Firstly, FIGS. 1 to 5 show a first preferred embodiment of the present invention, and show an example in which the present invention is applied to the mechanical pencil provided with a rotational drive mechanism which can rotate the writing lead using writing pressure.

FIG. 1 shows, in section, the whole structure. Reference numeral 1 indicates a body cylinder which constitutes the outside, and reference numeral 2 denotes a base member which is threadedly and detachably fitted to a tip portion of the above-mentioned body cylinder 1. A cylindrical lead case 3 is accommodated in the central part of the above-mentioned body cylinder 1 coaxially with the body cylinder 1, and a lead fixing chuck 4 is connected with a tip portion of this lead case 3.

In this lead fixing chuck 4, a through hole is formed along its axis, and its tip portion made of brass is divided into a plurality of pieces. The divided tip pieces are loosely fitted in a brass clamp 5 formed in the shape of a ring. Further, the above-mentioned ring-shaped clamp 5 is fitted inside a tip portion of a rotatable cam 6 which is arranged to cover the perimeter of the above-mentioned lead fixing chuck 4 and which is formed in the shape of a cylinder.

Figure 2:
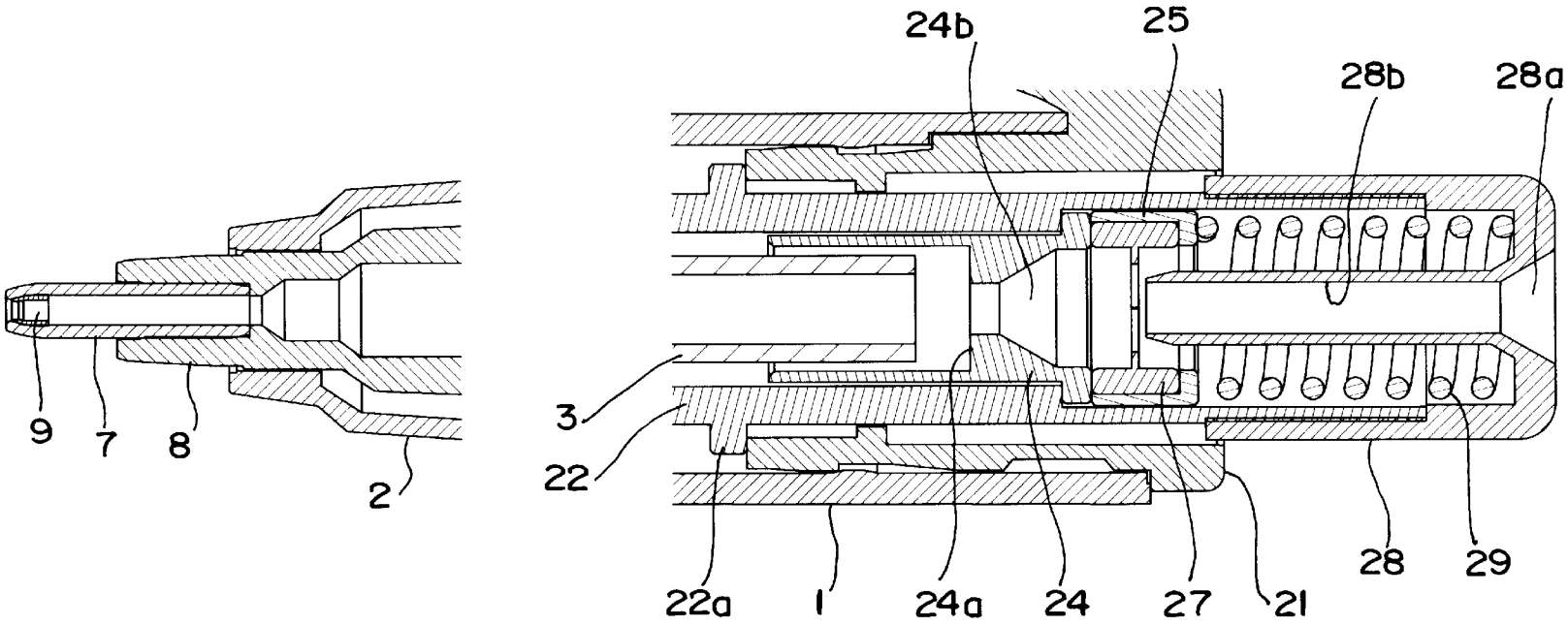
FIG. 2 is a sectional view to an enlarged scale of a base member and a rear end portion of the mechanical pencil shown in FIG. 1.

As shown also in FIG. 2, a pipe end 7 is provided to project from the above-mentioned base member 2. A base end portion of this pipe end 7 is fitted inside and attached to a tip portion of a slider 8 located at the above-mentioned base member 2. The above-mentioned slider 8 is formed so that its base end portion (rear end portion) side has a larger diameter, and an inner periphery of the base end portion is fitted and attached to an outer periphery at the tip portion of the above-mentioned rotatable cam 6. Further, as shown in FIG. 2, the rubber holder chuck 9 which has formed a through hole in its center and can hold the writing lead by friction is accommodated in the above-mentioned pipe end 7 at the inner periphery immediately adjacent to a writing lead outlet.

According to the above-described structure, a linear lead-inserting hole from the lead case 3 to the writing lead outlet of the pipe end 7 is formed via a through hole formed in the lead fixing chuck 4 and through holes formed in the above-mentioned pipe end 7 and the above-mentioned holder chuck 9. The writing lead (refill lead) to be set forth later is inserted into the linear lead-inserting hole. Further, a coil-like chuck spring 10 is disposed at a space part between the above-mentioned rotatable cam 6 and lead fixing chuck 4.

In addition, the above-mentioned chuck spring 10 is accommodated in the rotatable cam 6 in a situation where a rear end portion of the above-mentioned chuck spring 10 is in abutment with an end face of the above-mentioned lead case 3 and a front end portion of the above-mentioned chuck spring 10 is in abutment with an annular end face formed in the rotatable cam 6. Therefore, the lead fixing chuck 4 in the rotatable cam 6 is biased in a direction to retreat by the action of the above-mentioned chuck spring 10, and its tip portion is accommodated in the above-mentioned clamp 5, so that the writing lead is gripped in the through hole of the lead fixing chuck 4.

The above-mentioned rotatable cam 6 has a large diameter portion where a diameter at its central portion in the axial direction is enlarged. A number of cam faces in the shape of saw-tooth are continuously formed in a circle at one end face and the other end face of the large diameter portion, to constitute first and second rotatable cam faces.

On the other hand, at the rear end portion of the above-mentioned rotatable cam 6, an upper cam formation member 12 in the shape of a cylinder is provided in the body cylinder 1, so as to cover the back end of the above-mentioned rotatable cam 6. At a front end portion of the above-mentioned upper cam formation member 12, a first fixed cam face is formed to confront a first rotatable cam face in the above-mentioned rotatable cam 6.

Further, a lower cam formation member 13 is provided outside the above-mentioned rotatable cam 6, this lower cam formation member 13 is attached on the body cylinder 1 side, and the second fixed cam face is formed to confront the second rotatable cam face in the above-mentioned rotatable cam 6.

A number of cam faces in the shape of saw-tooth are continuously formed in a circle at the first and second fixed cam faces in the above-mentioned upper cam formation member 12 and the lower cam formation member 13. A pitch of these cams is arranged to be the same as that of the cams provided for the first and second rotatable cam faces in the above-mentioned rotatable cam 6 confronting the former cams.

In FIG. 1, a cylindrical stopper member 14 is fitted inside the rear end portion of the above-mentioned upper cam formation member 12 formed in the shape of a cylinder. A coil-like cushion spring 17 is provided between a front end portion of this stopper member 14 and a torque canceller 15 which is formed in the shape of a cylinder and can move in the axial direction.

The above-mentioned cushion spring 17 acts to bias the above-mentioned torque canceller 15 forward. It is arranged that the above-mentioned torque canceller 15 subjected to this bias force pushes the above-mentioned rotatable cam 6 to move forward.

Further, a cylindrical clip holder 21 which has formed a clip 21*a* integrally therewith is fitted into and attached to the rear end portion of the body cylinder 1. As shown also in FIG. 2, a knock bar 22 formed in the shape of a cylinder is accommodated inside the above-mentioned clip holder 21 so as to be slidable in the axial direction. This knock bar 22 is biased rearwardly of the body cylinder by a body spring 23 disposed between the knock bar itself and the above-mentioned stopper members 14. A flanged portion 22*a* formed at part of the knock bars 21 comes into abutment with a front end portion of the above-mentioned clip holder 21 so that the knock bar 22 may be prevented from being disengaged.

A short member 24 is attached to the above-mentioned knock bar 22. In the substantially central part of this short member 24, a face 24*a* which has formed a through hole in the center, i.e., an abutment face for abutment with the above-mentioned lead case 3 is formed, and a conical face 24*b* is formed at a rear end portion of the above-mentioned short member 24. A spring seat 25 whose diameter is somewhat reduced on its rear end portion side is provided at a rear portion of the above-mentioned short member 24. A rubber open/close valve 27 which constitutes an open/close mechanism for a writing lead feeding unit is disposed within a space of this spring seat 25 and behind the conical face 24*b* of the above-mentioned short member 24.

Figure 3:
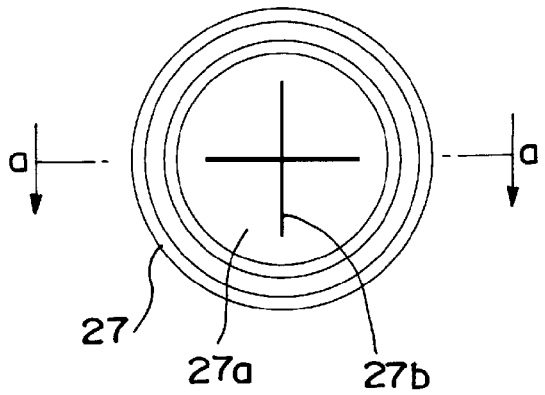
FIG. 3 are a plan view, a sectional view, and a perspective view, each showing a structure of an open/close valve made of a rubber material arranged at the rear end portion.
Figure 3:
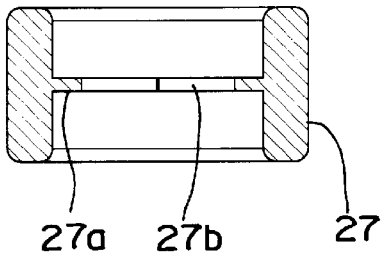
Figure 3:
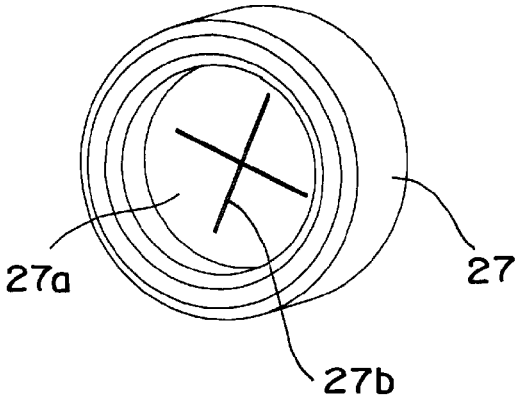

FIG. 3 show only the above-mentioned open/close valve 27 made of rubber, in which FIG. 3(A) is a front view, FIG. 3(B) is a sectional view taken in the direction of the arrows along the line a-a in FIG. 3(A), and FIG. 3(C) is a perspective diagram, each showing the valve 27.

As shown in FIG. 3, an outline of the above-mentioned open/close valve 27 is formed in the shape of a cylinder, and a thin film 27*a* is formed integrally with the valve 27 at a central part thereof in the direction perpendicular to the axis. In this preferred embodiment, a cross-shaped slit 27*b* is formed in the above-mentioned thin film 25*a*.

Returning to FIGS. 1 and 2, a knock cover 28 is mounted on the rear end portion of the above-mentioned knock bar 22. This knock cover 28 has formed a conic guide face 28*a* at its rear end portion. Following this guide face 28*a*, an inserting pipe 28*b* for the writing lead is formed integrally with the knock cover 28 in the axial direction. Further, surrounding the above-mentioned pipe 28*b*, a return spring 29 is provided between the above-mentioned spring seat 24 and an inner periphery of the rear end portion of the knock cover 28.

Furthermore, when in constant use, a tip portion of the writing lead inserting pipe 28*b* is adjusted so as not to reach the thin film 27*a* of the above-mentioned open/close valve 27 by the action of the above-mentioned return spring 29. That is to say, in this preferred embodiment, the open/close mechanism for the writing lead feeding unit is constituted by the inserting pipe 28*b* for the writing lead arranged at the knock cover 28 and the above-mentioned open/close valve 27 as the operation will be described in detail later.

According to the mechanical pencil having the above-described structure, in the case where the above-mentioned lead fixing chuck 4 is provided with the writing lead, knock operation of the above-mentioned knock cover 28 allows the writing lead to be gradually inched out of the writing lead outlet of the pipe end 7.

That is to say, as the above-mentioned knock cover 28 is knocked, the knock bar 22 moves forward, and the abutment face 24*a* of the short member 24 attached to the knock bar 22 pushes out the lead case 3 forward. Thus, as a tip portion of the lead fixing chuck 4 projects from the clamp 5, a grip on the writing lead is released. Further, as the above-mentioned knock operation is stopped, the lead case 3 is retreated by the body spring 23, and the lead fixing chuck 4 is retreated by the action of the chuck spring 10.

At this time, the writing lead is held by friction in the through hole formed in the holder chuck 9. In this situation, as the tip portion of the lead fixing chuck 4 is accommodated in the above-mentioned clamp 5, the chuck 4 again causes the writing lead to be in the gripped state. That is to say, by repeating the knock operation of the above-mentioned knock cover 28, the lead fixing chuck 4 is moved back and forth so that the writing lead is gripped and released, whereby the writing lead is gradually inched out of the writing lead outlet of the pipe end 7.

In addition, in this mechanical pencil, gripping the writing lead, the lead fixing chuck 4 is accommodated in the above-mentioned body cylinder 1 so that it can rotate about the axis together with the above-mentioned rotatable cam 6. The above-mentioned cushion spring 17 acts to urge the rotatable cam 6 forward via the above-mentioned torque canceller 15.

In this situation, when writing is carried out, i.e., when writing pressure is applied to the writing lead (not shown) which has projected from the pipe end 7, the above-mentioned lead fixing chuck 4 gripping the writing lead retreats slightly in the axial direction against the bias force of the cushion spring 17. In conjunction with this, the rotatable cam 6 also retreats in the axial direction. Therefore, the first rotatable cam faces formed in a circle in the rotatable cam 6 are brought into meshed engagement with the above-mentioned first fixed cam faces similarly formed in a circle, and the rotatable cam 6 is subjected to the rotational drive corresponding to a half-phase (half-pitch) of one tooth of the first rotatable cam face in one direction.

When the writing of one stroke finishes and the writing pressure to the writing lead is released, the rotatable cam 6 is moved forward slightly in the axial direction by the action of the above-mentioned cushion spring 17, and the second rotatable cam faces formed in a circle at the rotatable cam 6 are brought into meshed engagement with the above-mentioned second fixed cam faces similarly formed in a circle, whereby the rotatable cam 6 is again subjected to the rotational drive corresponding to a half-phase (half-pitch) of one tooth of the second rotatable cam face.

As described above, according to the above-mentioned mechanical pencil, in conjunction with the axially reciprocating motion of the rotatable cam 6 being subjected to the writing pressure, the rotatable cam 6 is intermittently and rotationally driven in one way. Thus, the tip portion of the writing lead is always caused to be in the shape of a cone by wearing due to the writing and by the rotational motion applied to itself. Thus, it is possible to prevent the writing lead from being locally abraded as the writing proceeds and allow the writing with a stable line width.

Figure 4:
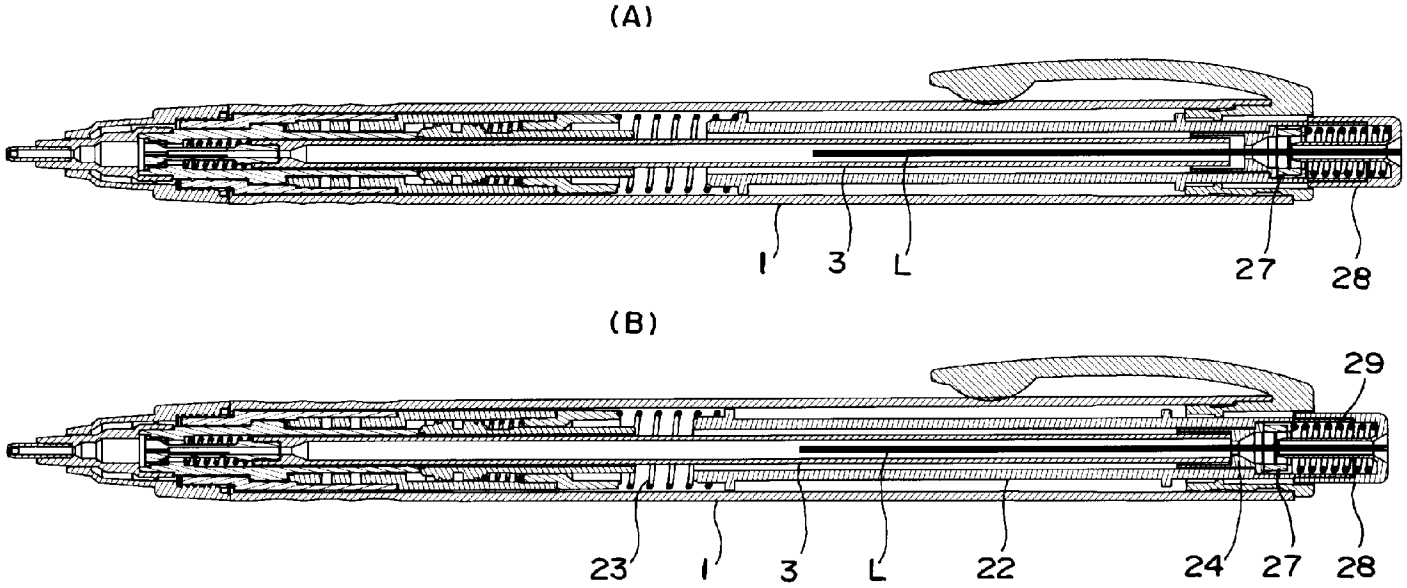
FIG. 4 are sectional views showing in order how a writing lead is supplied.
Figure 5:
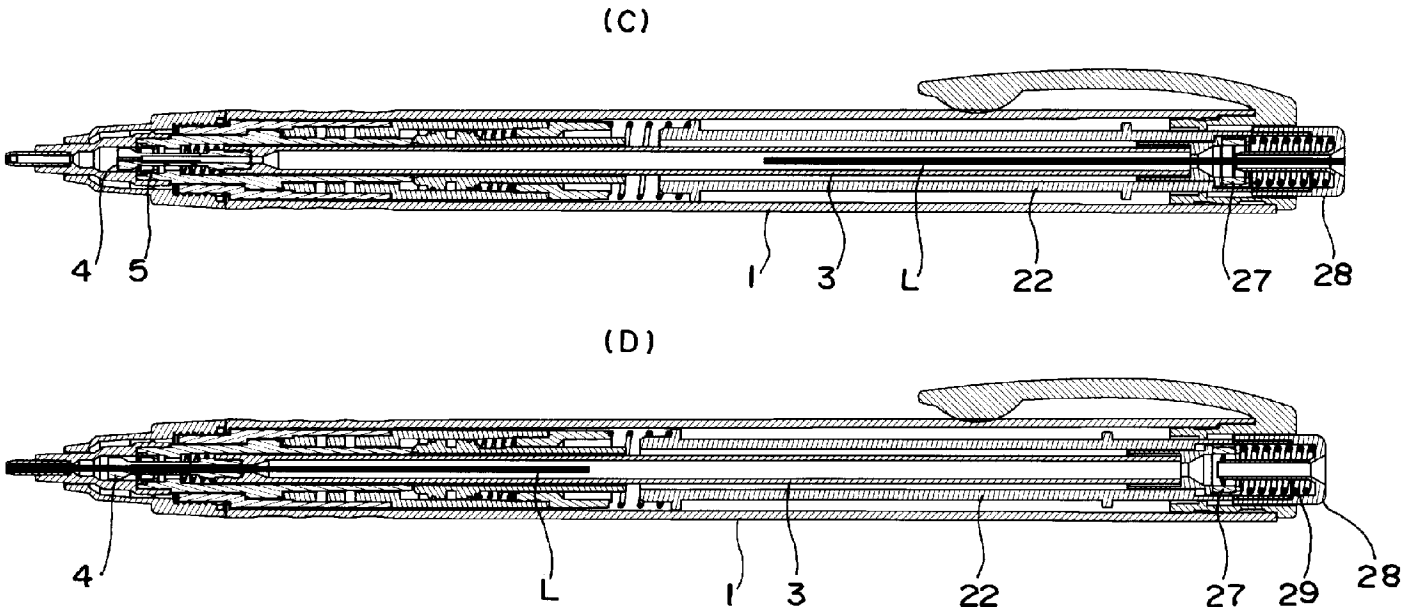
FIG. 5 are sectional views showing in order how the supplied writing lead reaches a writing lead outlet of a pipe end, following FIG. 4.

FIGS. 4 and 5 are for explaining in order how the writing lead is supplied in the mechanical pencil having the structure as described above. When supplying the writing lead, as first shown in FIG. 4(A), a writing lead L is inserted into the writing lead inserting pipe 28*b* provided for the knock cover 28. In this case, since the slit 27*b* is provided for the thin film 27*a* of the open/close valve 27 made of a rubber material, it is possible to readily insert a tip portion of the writing lead L, while flexing a part of above-mentioned thin film 27*a*.

Further, the whole lead L is operated by a fingertip to enter the lead inserting pipe 28*b*, so that the lead tip enters the lead case 3. In this situation, the lead L is held by the slit 27*b* in the open/close valve 27.

FIG. 4(B) shows an initial state where the knock cover 28 is knocked, and shows a situation where the knock bar 22 has been moved forward by the knock operation and the abutment face 24*a* of the above-mentioned short member 24 attached to the knock bar 22 is in abutment with the rear end portion of the lead case 3. In this situation, because of a spring constant ($k=P/\delta$), the body spring 23 is slightly compressed and there is no change in the return spring 29 within the knock cover 28. Therefore, the writing lead L is left held by the slit 27*b* of the open/close valve 27.

FIG. 5(C) shows a situation where the knock operation of the knock cover 28 has progressed and the lead fixing chuck 4 has projected from the clamp 5, thus causing the lead fixing chuck 4 to release the grip on the writing lead. However, even in this situation, the writing lead L is left held by the slit 27*b* of the open/close valve 27.

FIG. 5(D) shows a situation where the knock operation of the knock cover 28 has further progressed and the lead fixing chuck 4 leaves the grip on the writing lead released, thereby restricting further advancement of the lead fixing chuck 4. Thus, the knock bar 22 is stopped from moving forward, and the return spring 29 in the knock cover 28 is compressed in the axial direction relatively.

According to this operation, the tip portion of the writing lead inserting pipe 28*b* formed in the knock cover 28 moves into the slit 27*b* formed in the thin film 27*a* of the open/close valve 27.

Thereby, the open/close mechanism for the writing lead feeding unit is opened, and the lead L held by the slit 27*b* of the open/close valve 27 falls toward the lead fixing chuck 4 side by gravity. At this time, since the lead fixing chuck 4 is left released, the tip portion of the writing lead L immediately reaches (falls in) a position where the holder chuck 9 is disposed proximate to the writing lead outlet of the pipe end 7. As described above, with reference to FIGS. 4 and 5, the above operation is realized by the first knock operation of the knock cover 28.

Therefore, the tip portion of the supplied writing lead L immediately reaches the position where the holder chuck 9 is disposed proximate to the writing lead outlet of the pipe end 7. So, then the knock cover is knocked one or two times, so that the lead fixing chuck 4 and the holder chuck 9 act to inch out the writing lead L, and the tip portion of the writing lead L is inched from the pipe end 7, thus allowing writing at once.

Figure 6:
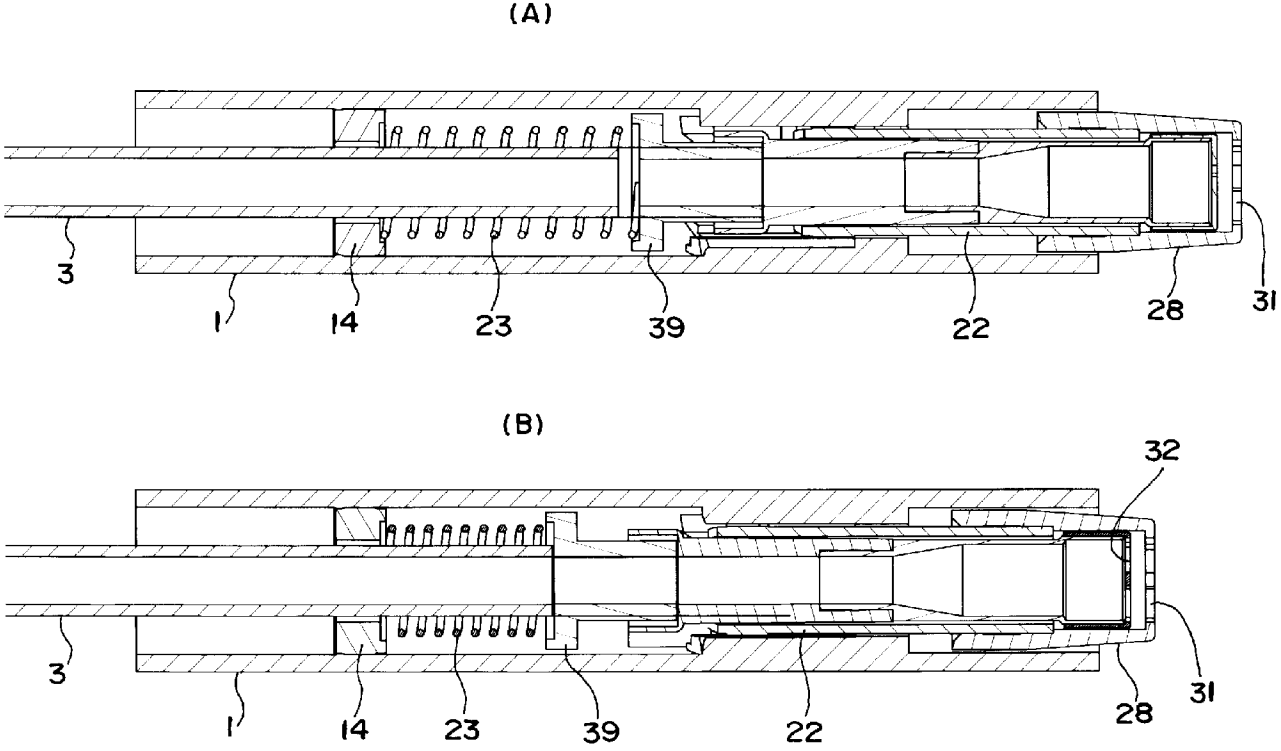
FIG. 6 are sectional views respectively showing an unlocked state and a locked state, with respect to a second preferred embodiment of the mechanical pencil in accordance with the present invention.
Figure 7:
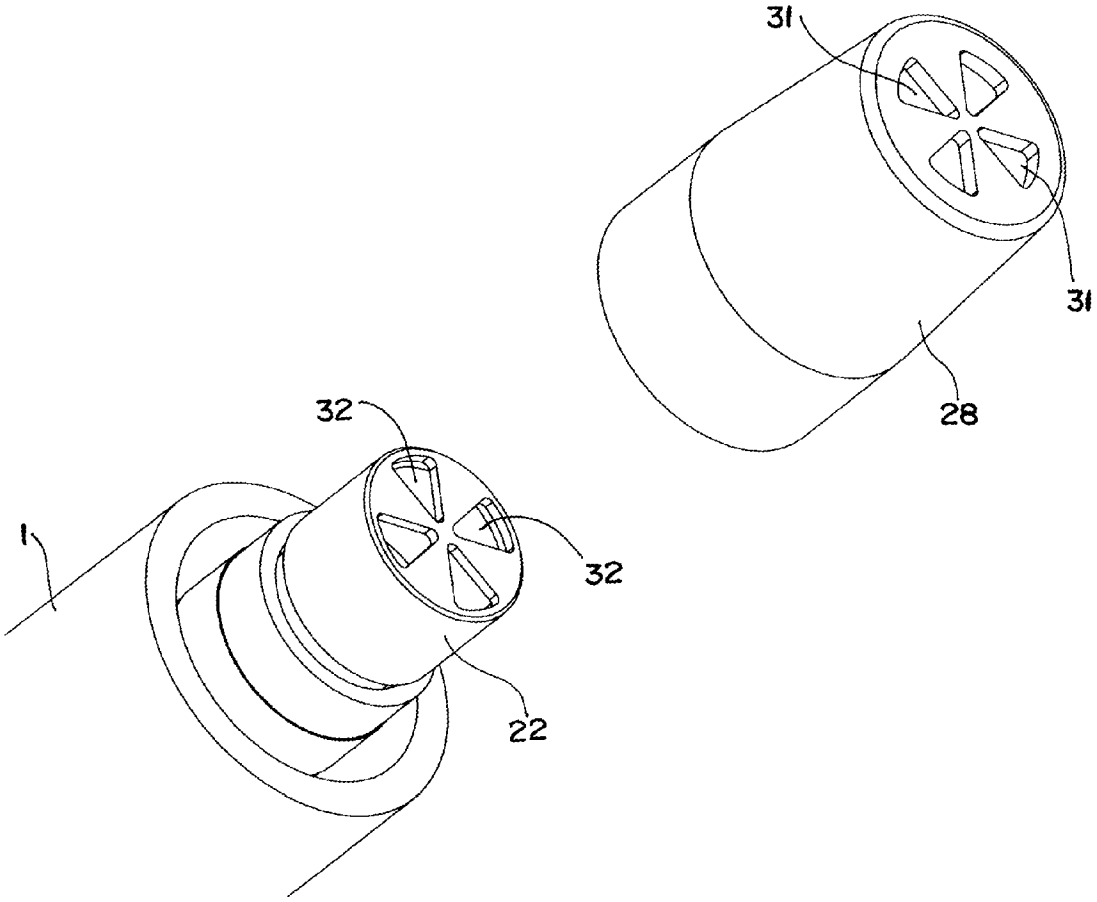
FIG. 7 is a perspective view showing an arrangement of the knock cover of the mechanical pencil shown in FIG. 6, and a writing lead feeding unit provided near an end portion of a knock bar.
Figure 8:
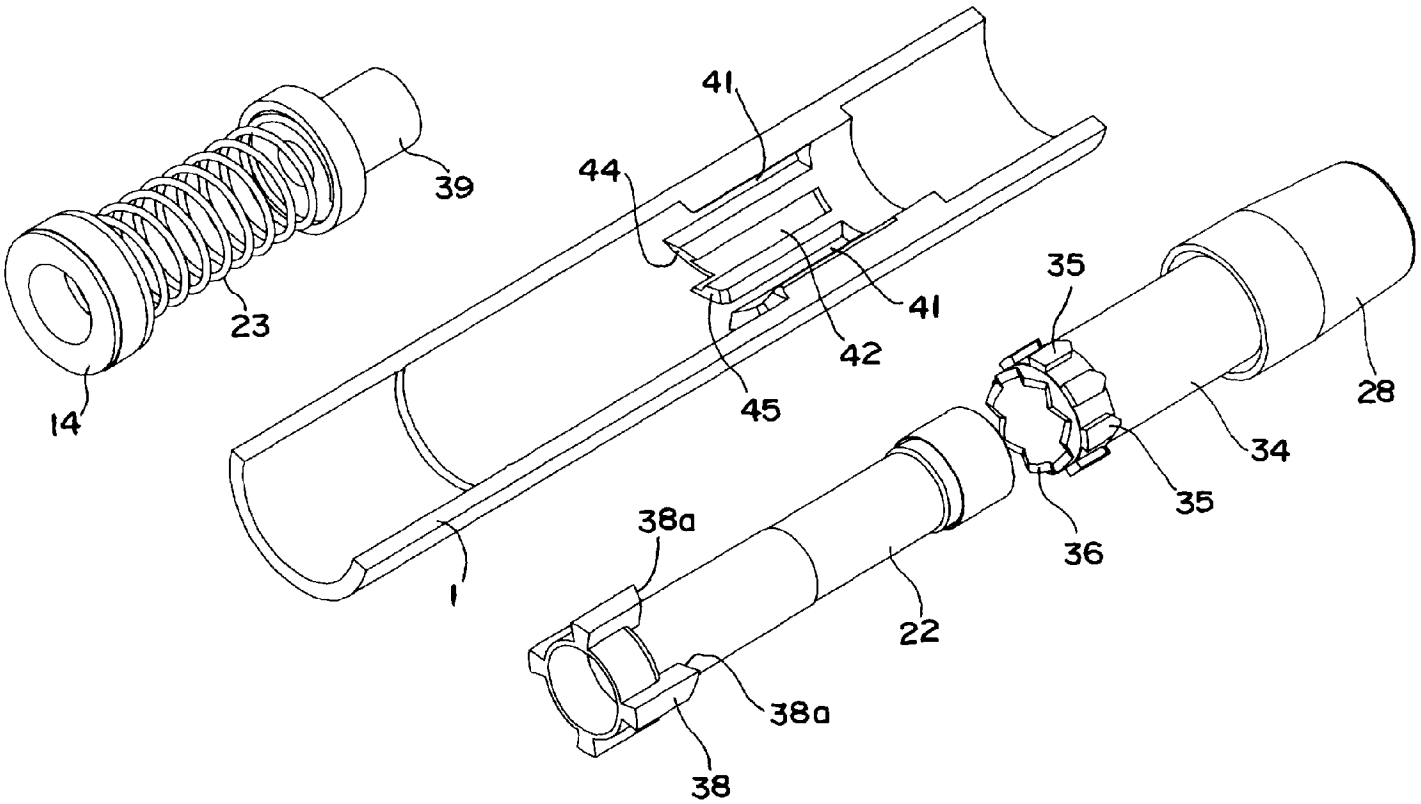
FIG. 8 is an exploded perspective view showing an internal structure of the writing lead feeding unit shown in FIG. 7.

Next, FIGS. 6 to 8 show a second preferred embodiment of the mechanical pencil in accordance with the present invention, and mainly illustrate the open/close mechanism for the writing lead feeding unit. It should be noted that, also in the second preferred embodiment, a structure of the base member portion is similar to that of the first preferred embodiment as shown in FIG. 2, and a structure is employed in which the rubber holder chuck 9 that can hold the writing lead by friction is accommodated immediately adjacent to the lead outlet in the pipe end 7.

It is arranged that the knock cover 28 and the knock bar 22 of the mechanical pencil in the second preferred embodiment are locked in a situation where, upon knock operation, they have moved forward in the axial direction, and upon further knock operation they retreat in the axial direction to cancel the above-mentioned locked state.

FIG. 6 show in section a part of the open/close mechanism for the writing lead feeding unit provided for the rear end portion. FIG. 6(A) shows a case where the locked state is canceled (unlocked state), and FIG. 6(B) shows a case where they are in the locked state upon knock operation.

As shown in FIG. 7, a top surface of the knock cover bar 28 has formed therein openings 31 around the circumference at 90 degree intervals. On the other hand, openings 32 are formed around the circumference at 90 degree intervals at the knock bar 22 side covered by the above-mentioned knock cover 28.

In this preferred embodiment, the above-mentioned locked state and the unlocked state are repeated alternately by knocking the above-mentioned knock cover 28. It is arranged that each time the above-mentioned locked state is switched to the unlocked state or vice-versa, the above-mentioned knock bar 22 side may be rotated about the axis by an angle of 45 degrees.

Further, the opening 31 formed in the knock cover 28 in the above-mentioned locked state and the opening 32 formed at the knock bar 22 side are in alignment with each other in the axial direction, and the writing lead feeding unit is opened. Furthermore, in the unlocked state, both the openings are not in alignment with each other in the axial direction, and the open/close mechanism for the writing lead feeding unit is closed. As described above, the writing lead is supplied in the locked state and in a situation where the writing lead feeding unit is opened, so that the writing lead immediately moves into the lead case 3 as shown in FIG. 6.

FIG. 8 shows a few members which constitute the above-mentioned open/close mechanism for the lead feeding unit in exploded form. Part of the members are shown in perspective, and the other part which is cut in half along the axis is shown. The above-mentioned knock cover 28 is attached to one end of a cylindrical body 34. Eight projecting members 35 are arranged at regular intervals circumferentially around the periphery of the other end of this cylindrical body 34. Further, undulations 36 having crests and valleys alternately are formed at an end face in which the projecting member 35 of the cylindrical body 34 are formed. In this example, eight undulations per circumference are continuously formed.

On the other hand, four rib members 38 are circumferentially formed at regular intervals around the periphery of the knock bar indicated by reference number 22. A slope 38*a* is formed near a rear end of each rib member 38. The above-mentioned knock bar 22 is assembled in such a way that it is inserted into the opening at which the undulations 36 of the above-mentioned cylindrical body 34 are formed and the slope 38*a* of each rib member 38 may come into contact with the undulation 36 of the cylindrical body 34.

Further, an end face of a slide pipe 39 which is biased by the body spring 23 is brought into abutment with an opening around which the rib members 38 of the knock bar 22 are formed. That is to say, the body spring 23 is supported by the stopper member 14 which is fitted to a portion in the body cylinder 1, as shown in FIG. 6.

As shown in FIG. 8, eight grooves are formed in the axial direction in the above-mentioned body cylinder 1, where deep grooves 41 and shallow grooves 42 are alternately formed in a circumferential direction. Further, slopes 44 having a large width and slopes 45 having a small width are alternately formed in the body cylinder at the front side where the shallow grooves 42 are formed.

Eight projecting members 35 formed at the above-mentioned cylindrical body 34 enter and slide in the eight grooves 41 and 42 formed in the body cylinder 1. Therefore, the knock cover 28 attached to the cylindrical body 34 is slid only in the axial direction by knock operation, and cannot be rotated.

On the other hand, the rib member 38 of the knock bar 22 accommodated in the cylindrical body 34 falls into the deep groove 41 formed in the body cylinder 1 or it is brought into engagement with the wide slope 44.

For example, in the above-mentioned unlocked state, the rib member 38 of the above-mentioned knock bar 22 falls into the deep groove 41 formed in the body cylinder 1, and the knock bar 22 together with the knock cover 28 is caused to project from the rear end portion of the body cylinder. At this time, the open/close mechanism for the writing lead feeding unit is left closed.

In this state, as the knock cover 28 is knocked, the rib member 38 of the knock bar 22 is pushed and moved forward by the undulations 36 of the cylindrical body 34, and caused by the action of the undulations 36 and slope 38*a* to ride up the wide slope 44 formed at the body cylinder 1. At this time, the knock bar 22 axially rotates by 45 degrees and caused to be in the above-mentioned locked state. At this time, the open/close mechanism for the writing lead feeding unit is left opened.

In this locked state, as the knock cover 28 is again knocked, the rib member 38 of the knock bar 22 rides on the narrow slope 45 formed at the body cylinder 1. Then, it falls into the deep groove 41 formed at the body cylinder 1, and caused to be in the unlocked state.

That is to say, each time the knock bar 22 is knocked, the above-mentioned locked state is switched to the unlocked state and vice-versa, which is repeated. In conjunction with this, the open/close mechanism for the writing lead feeding unit is opened and closed as already described.

Further, in the locked state, as shown in FIG. 6, a front end face of the slide pipe 39 pushes out the lead case 3, so that the above-mentioned lead fixing chuck 4 disposed at the front end portion of the lead case 3 is caused to release the grip on the writing lead.

Also in the second preferred embodiment as shown in FIGS. 6 to 8, the open/close mechanism for the writing lead feeding unit is opened in the locked state. The writing lead supplied in the writing lead feeding unit immediately reaches (falls in) the position where the holder chuck 9 is disposed proximate to the writing lead outlet of the pipe end 7

Therefore, as the knock cover is knocked one or two times, the lead fixing chuck 4 and the holder chuck 9 act to inch out the writing lead L, and the tip portion of the writing lead L is inched from the pipe end 7, thus allowing writing at once.

Thus, also in the first preferred embodiment as shown in FIGS. 1 to 5 and the second preferred embodiment as shown in FIG. 6 to FIG. 8, when supplying the writing lead, it is possible to avoid removal or reattachment of a cap and the knock operation that has been necessarily repeated many times.

It should be noted that although the rotational drive mechanism is provided for rotating the writing lead according to writing in the above-described preferred embodiments, the present invention is not only applied to the mechanical pencil having the particular structure as described above, but also similar operational effects can be expected when the present invention is applied to the other mechanical pencils without the above-mentioned rotational drive mechanism for the writing lead.

EXPLANATION OF REFERENCE SIGNS

1: body cylinder
2: base member
3: lead case
4: lead fixing chuck
5: clamp
6: rotatable cam
7: pipe end
8: slider
9: holder chuck
10: chuck spring
12: upper cam formation member
13: lower cam formation member
14: stopper member
15: torque canceller
17: cushion spring
21: clip holder
22: knock bar
23: body spring
24: short member
25: spring seat
27: open/close valve
27*a*: thin film
27*b*: slit
28: knock cover
28*a*: guide face
28*b*: writing lead inserting pipe
29: return spring
31, 32: openings
35: projecting member
36: undulations
38: rib member
41, 42: grooves
L: writing lead

The invention claimed is:

1. A mechanical pencil, comprising:

a first axial end having an opening from which a writing lead can protrude for a writing operation, and a second axial end having a knock cover, said knock cover having an opening into which said writing lead can be fed from outside the mechanical pencil without removing the knock cover, a lead fixing chuck, which is movable back and forth in conjunction with a knock operation of a knock bar, to grasp and release said writing lead, a holder chuck disposed in front of said lead fixing chuck, said holder chuck holding said writing lead frictionally so that said writing lead can be gradually inched out by repeating said knock operation, and an open/close mechanism for a writing lead feeding unit, said writing lead feeding unit being opened in a situation where a grip of said lead fixing chuck on the writing lead is released by said knock operation, so as to feed said writing lead from outside the mechanical pencil without removing the knock cover, wherein said holder chuck is disposed proximate to an outlet for said writing lead.

2. The mechanical pencil as claimed in claim 1, wherein said open/close mechanism for the writing lead feeding unit comprises the knock cover, the knock cover being attached to said knock bar and having a writing lead inserting pipe disposed in an axial direction of the mechanical pencil, and an open/close valve made of a flexible material and through which a tip portion of said writing lead inserting pipe is inserted by forward movement by a knock operation of said knock cover, to open the writing lead feeding unit.

3. The mechanical pencil as claimed in claim 2, wherein said open/close valve comprises a thin film of a rubber material with a slit, and wherein a tip portion of said writing lead inserting pipe of said knock cover is inserted into said slit of the rubber material by said knock operation of said knock cover, to open the writing lead feeding unit.

4. The mechanical pencil as claimed in claim 1, wherein said open/close mechanism for the writing lead feeding unit is configured such that said knock bar is rotationally driven and moved in an axial direction of the mechanical pencil by said knock operation, and wherein an opening formed in said knock bar and the opening formed in said knock cover are aligned in the axial direction of the mechanical pencil so as to open the writing lead feeding unit, said knock cover being attached to said knock bar.

5. The mechanical pencil as claimed in claim 4, wherein said knock bar is configured such that said knock bar is subjected to said knock operation and locked in a situation where said knock bar is moved forward in the axial direction of the mechanical pencil, and is unlocked in a situation where said knock bar is then subjected to said knock operation again and retreats in the axial direction of the mechanical pencil, and wherein, in the locked situation, the writing lead feeding unit is opened and the grip of said lead fixing chuck on the writing lead is released.

* * * * *